US006343475B1

(12) United States Patent
Ishikawa

(10) Patent No.: US 6,343,475 B1
(45) Date of Patent: Feb. 5, 2002

(54) PULSE TUBE REFRIGERATOR WITH CARTRIDGE TYPE REGENERATOR

(75) Inventor: Atsutoshi Ishikawa, Tokorozawashi (JP)

(73) Assignee: Sumitomo Heavy Industries, Inc., Tokyo (JP)

( * ) Notice: Subject to any disclaimer, the term of this patent is extended or adjusted under 35 U.S.C. 154(b) by 0 days.

(21) Appl. No.: 09/666,865

(22) Filed: Sep. 21, 2000

(30) Foreign Application Priority Data

Sep. 29, 1999 (JP) ..... 11-275981
Mar. 15, 2000 (JP) ..... 2000-73030

(51) Int. Cl.[7] ..... F25B 9/00
(52) U.S. Cl. ..... 62/6
(58) Field of Search ..... 62/6; 165/44

(56) References Cited

U.S. PATENT DOCUMENTS 5,701,743 A * 12/1997 Hagiwara et al. ..... 62/6
5,845,498 A * 12/1998 Matsui et al. ..... 62/6

* cited by examiner

*Primary Examiner*—William Doerrler
*Assistant Examiner*—Malik N. Drake
(74) *Attorney, Agent, or Firm*—Arent Fox Kintner Plotkin & Kahn PLLC

(57) ABSTRACT

A pulse tube, a high temperature end and a low temperature end being defined thereof, has an inner space. A regenerator case defined a high temperature end and a low temperature end. A regenerator includes a cartridge case and a regenerator material filled in the cartridge case. The cartridge case is removably inserted into the regenerator case. A first passage communicates a space in the regenerator on a low temperature end side into which case the regenerator is inserted, with a space in the pulse tube on a low temperature end side. A gas supply unit repeats a supply and a recovery of a working gas. A second passage couples the gas supply unit to a space in the regenerator case on a high temperature end side into which case the regenerator is inserted.

10 Claims, 7 Drawing Sheets

PULSE TUBE REFRIGERATOR WITH CARTRIDGE TYPE REGENERATOR

This application is based on Japanese Patent Applications HEI 11-275981, filed on Sep. 29, 1999 and 2000–73030, filed on Mar. 15, 2000, the entire contents of which are incorporated herein by reference.

BACKGROUND OF THE INVENTION a) Field of the Invention

The present invention relates to a pulse tube refrigerator, and more particularly to a pulse tube refrigerator with improved housing structures for regenerating material or the like. The pulse tube refrigerator is used with precise physical and chemical apparatuses such as an NMR and an electron microscope.

b) Description of the Related Art

Ultra low temperature refrigerators such as pulse tube refrigerators are widely used for maintaining a low temperature environment for precise physical and chemical apparatuses such as an NMR and an electron microscope.

FIG. 7 is a cross sectional view showing the main part of a conventional pulse tube refrigerator 1. The pulse tube refrigerator 1 has: a compressor 2; a valve unit 3 for switching between high and low pressures; a high temperature end block 4; a low temperature end block (cooling end block) 5; a regenerator 6; a pulse tube 7; a flow rectifier 8 at a regenerator low temperature end; a flow rectifier 9 at a pulse tube low temperature end; and a flow rectifier 10 at a pulse tube high temperature end.

The high temperature end block 4 has a working gas supply port 11 and a working gas reciprocal port 12. Working gas or fluid such as helium gas is pulsatively supplied from the working gas supply port 11, via the inside of a supply port space 13, and to the regenerator 6. A buffer tank 15 is coupled to the working gas reciprocal port 12. An orifice 14 is provided in the working gas reciprocal port 12. The high temperature end block 4 is mounted on a mount flange 16 with mount bolts 17.

The regenerators is constituted of a regenerator case 18 disposed between the high temperature block 4 (mount flange 16) and the low temperature end block 5, and a. regenerating material 19 housed in the regenerator case 18. As the regenerating material 19, copper material, stainless steel material, metal fibers or punching metal is used. The regenerator 19 is filled in the regenerator case 18 at a predetermined density. While the working gas passes through the inside of the regenerator 6, regeneration is performed between the working gas and regenerating material 19 to cool the regenerating material 19.

The low temperature end block 5 is disposed facing the high temperature end block 4 at a predetermined distance. The regenerator 6 and pulse tube 7 are disposed generally in parallel between the low temperature end block 5 and high temperature end block 4. A commuter space 20 is formed in the low temperature end block 5 to make the lower temperature end of a gas passage in the regenerator 6 communicate with the low temperature end of the gas passage in the pulse tube 7. In the commuter space 20, the flow rectifier 8 at the regenerator low temperature end is disposed in a space 21 on the regenerator 6 side, and the flow rectifier 9 at the pulse tube low temperature end is disposed in a space 22 on the pulse tube 7 side.

The flow rectifier 8 at the regenerator low temperature side is made of flow rectifying material 23 (first flow rectifying material) filled in the space 21. The flow rectifier 9 at the pulse tube low temperature side is made of flow rectifying material 24 (second flow rectifying material) filled in the space 22.

The high temperature end of the pulse tube 7 communicates with the working gas reciprocal port 12 via the flow rectifier 10 at the pulse tube high temperature end.

The flow rectifier 10 at the pulse tube high temperature end is made of flow rectifying material 26 (third flow rectifying material) filled in a space 25 formed in the high temperature end block 4.

The flow rectifying materials 23, 24 and 26 are, for example, metal meshes or punching metal.

The working gas is pulsatively supplied into the regenerator 6 via the working gas supply port 11 and supply port space 13. This working gas is also supplied into the pulse tube 7 via the flow rectifier 8, commuter space 20 and flow rectifier 9. The pressure and volume of the working gas in the pulse tube 7 are changed. The flow rectifiers 9 and 10 rectify the working gas flow in the pulse tube 7. The phases of the pressure change and volume change are controlled by the orifice 14 and buffer tank 15. Heat is absorbed in the low temperature end block 5.

In the conventional pulse tube refrigerator 1, the regenerating material 19 is directly filled in the regenerator case 18. Similarly, the flow rectifying material 23 is directly filled in the regenerator side space 21, the flow rectifying material 24 is directly filled in the pulse tube side space 22, and the flow rectifying material 26 is directly filled in the orifice side space 25.

During the operation of the pulse tube refrigerator 1, if impurities such as water contents and other fluids are solidified, the regenerating material 19 or flow rectifying material 23, 24 or 26 may be clogged with the impurities. In such a case, the cooling performance may be lowered. In order to recover the original cooling performance, the temperature of the clogged areas are raised to remove solidified fluid contents.

However, if impurities are oil or the like flowed from the compressor 2, these impurities are difficult to be removed by raising the temperature of the clogged areas. In this cases it is necessary to replace the regenerating material 19 or flow rectifying material 23, 24 or 26 by new one.

In order to replace the regenerating material 19 or flow rectifying material 23, 24 or 26, it is necessary to stop the operation of a precise physical and chemical apparatus (cooling object) cooled with the pulse tube refrigerator 1 and raise the temperature thereof. This operation stop and temperature rise lower a running efficiency of the apparatus. In addition, a cooling operation is again required after material replacement, which results in a large cost and work and a long work time.

Furthermore, since the regenerating material 19 and flow rectifying materials 23, 24 and 26 are directly filled in the spaces, a replacement work itself is neither simple nor efficient.

Another type of a conventional pulse tube refrigerator has a structure that a flow rectifier (not shown) for communicating the working gas supply port 11 with the high temperature end of the regenerator 6 is provided by directly filling flow rectifying material (fourth flow rectifying material) in the supply port space 13 of the high temperature end block 4. Also with this pulse tube refrigerator having such a structure, a replacement work for flow rectifying material is not simple and a maintenance efficiency is lowered.

SUMMARY OF THE INVENTION

It is an object of the present invention to provide a pulse tube refrigerator capable of cold maintenance without an operation stop and temperature rise of a precise physical and chemical apparatus, by using a cartridge type regenerator and cartridge type flow rectifiers easy to be replaced.

It is another object of the present invention to provide a pulse tube refrigerator capable of easily replacing a clogged regenerating material or flow rectifying material.

According one aspect of the present invention, there is provided a pulse tube refrigerator comprising: a first pulse tube, a high temperature end and a low temperature end being defined at both ends thereof, and having an inner space; a first regenerator case of a tubular type, a high temperature end and a low temperature end being defined at both sides thereof; a first regenerator including a first cartridge case and a first regenerating material filled in the first cartridge case, the first cartridge case being removably inserted into said first regenerator case; a first passage communicating a space in said first regenerator case on a low temperature end side into which case said first regenerator is inserted, with a space in said first pulse tube on a low temperature end side; a gas supply unit for repeating a supply and a recovery of a working gas; and a second passage for coupling said gas supply unit to a space in said first regenerator case on a high temperature end side into which case said first regenerator is inserted.

Since the first regenerator can be removably mounted, the first regenerating material can be easily exchanged when the first regenerating material is clogged.

According another aspect of the present invention, there is provided a maintenance method for a pulse tube refrigerator having: a pulse tube, a high temperature end and a low temperature end being defined at both ends thereof, and having an inner space; a regenerator case of a tubular type, a high temperature end and a low temperature end being defined at both ends thereof; a regenerator including a cartridge case and a regenerating material filled in the cartridge case, the cartridge case being removably inserted into the regenerator case; a first passage communicating a space in the regenerator case on a low temperature end side into which case the regenerator is inserted, with a space in the pulse tube on a low temperature end side; a gas supply unit for repeating a supply and a recovery of a working gas; and a second path for coupling the gas supply unit to a space in the regenerator case on a high temperature end side into which case the regenerator is inserted, the method comprising the steps of: stopping an operation of the pulse tube refrigerator; covering the high temperature end of the regenerator case with a glove box so as to prevent atmospheric air from entering the space in the regenerator case even if the high temperature side of the regenerator case is opened, and preparing a new regenerator in the glove box; pulling the regenerator out of the regenerator case; and inserting the new regenerator into the regenerator case.

Since the high temperature end of the regenerator case is covered with a glove box even if the regenerator is dismounted, atmospheric air will not enter the inside of the regenerator case. Therefore, the regenerator can be replaced by a new one without raising the temperature at the low temperature end.

DETAILED DESCRIPTION OF THE PREFERRED EMBODIMENTS

Figure 1:
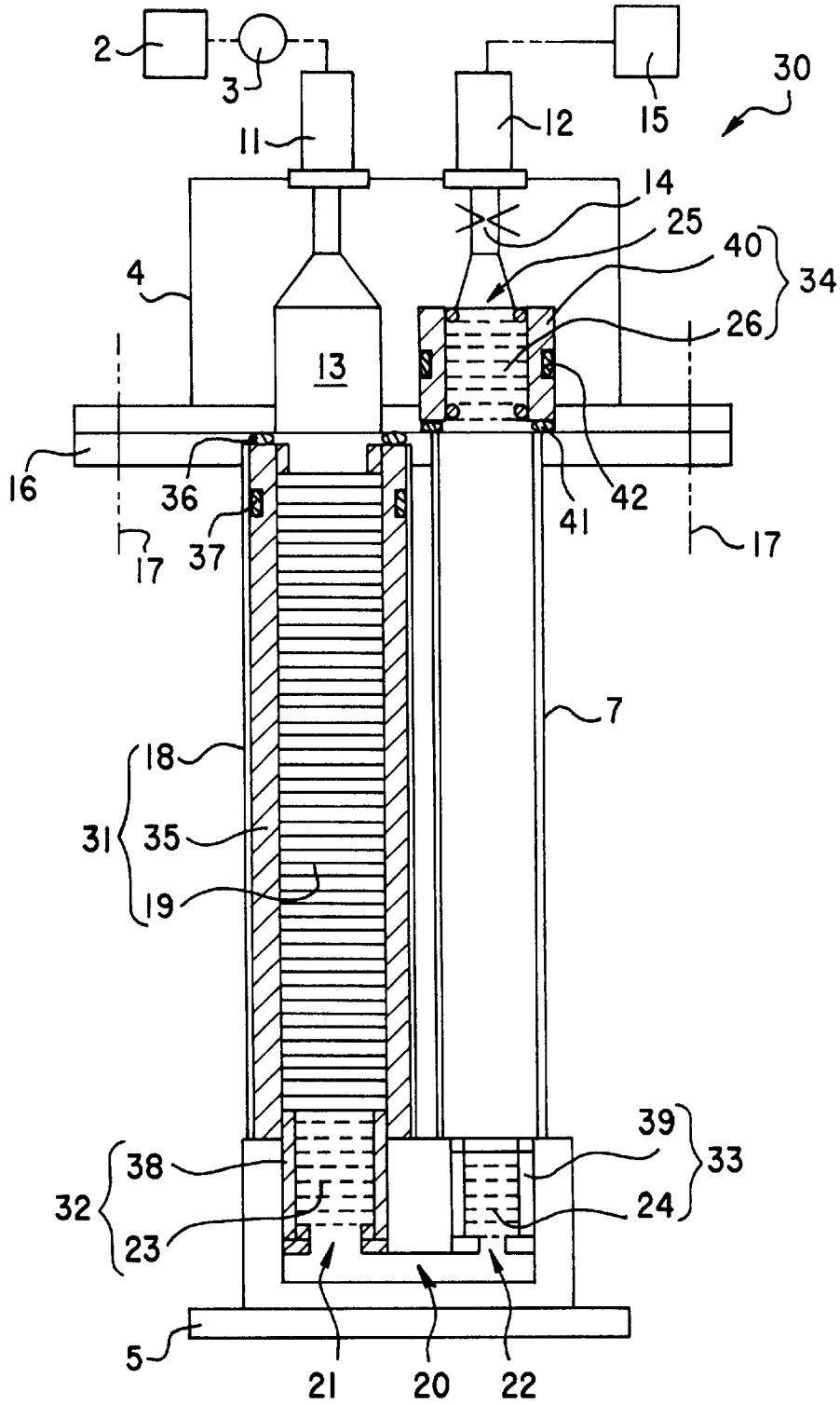
FIG. 1 is a cross sectional view showing the main part of a pulse tube refrigerator according to a first embodiment of the invention.
Figure 2:
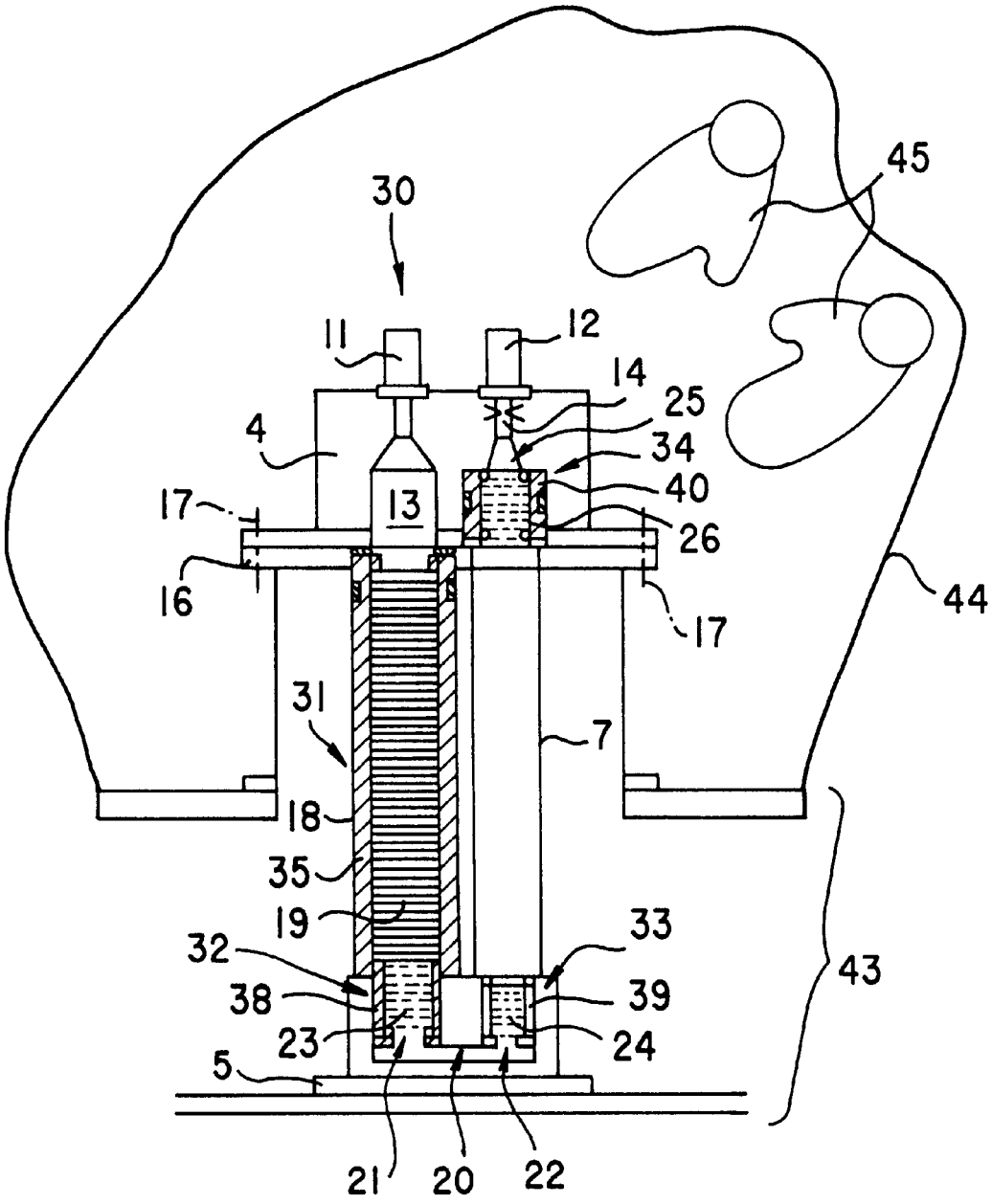
FIG. 2 is a cross sectional view showing the main part of the pulse tube refrigerator under maintenance according to the first embodiment of the invention.
Figure 7:
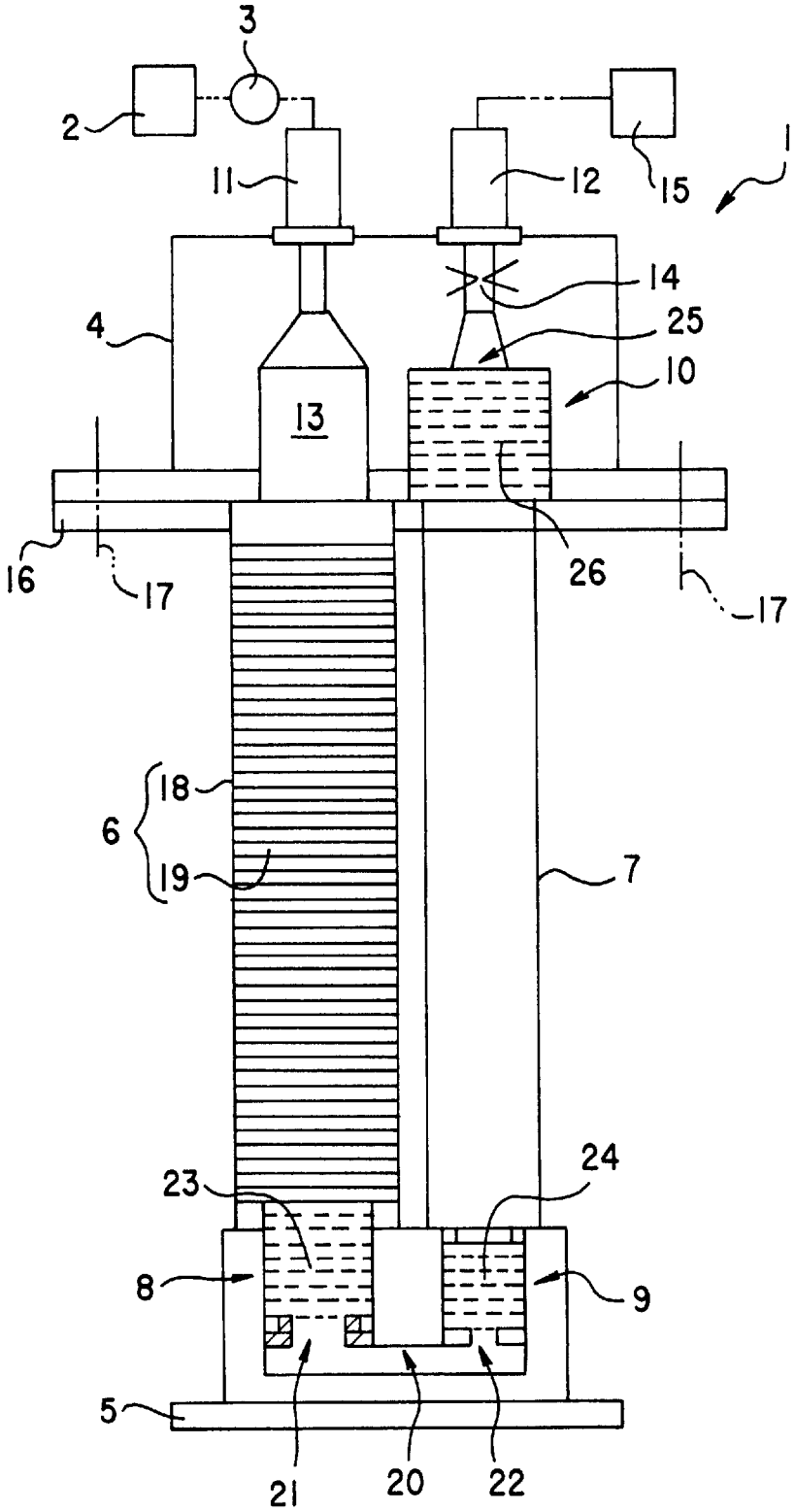
Fig.7 PRIOR ART
FIG. 7 is a cross sectional view showing a main part of a conventional pulse tube refrigerator.

With reference to FIGS. 1 and 2, a pulse tube refrigerator according to a first embodiment of the invention will be described. In FIGS. 1 and 2, identical reference numerals are used for representing constituent elements of the pulse tube refrigerator of the first embodiment corresponding to those of the conventional pulse tube refrigerator shown in FIG. 7, and the detailed description thereof is omitted.

FIG. 1 is a cross sectional view showing the main part of the pulse tube refrigerator 30 of the first embodiment. In place of the regenerator 6 and flow rectifiers 8, 9 and 10 of the conventional pulse tube refrigerator 1 shown in FIG. 7, the pulse tube refrigerator 30 of this embodiment has a cartridge type regenerator 31 and cartridge type flow rectifier 32, 33 and 34. The other structures are the same as those of the conventional pulse tube refrigerator 1 shown in FIG. 1.

The cartridge type regenerator 31 is constituted of a regenerator case 18, a cartridge case 35 and a regenerating material 19. The regenerator case 18 is made of a tubular member in which the tubular cartridge case 35 is inserted. The regenerating material 19 is filled in the cartridge case 35.

An O-ring 36 is disposed between the cartridge case 35 and high temperature end block 4. Another O-ring 37 is disposed near at the high temperature end between the regenerator case 18 and cartridge case 35. The O-rings 36 and 37 prevent the working gas from entering a gap between the regenerator case 18 and cartridge case 35.

The cartridge case 35 is made of bakelite, other plastic materials, or stainless steel material having a low thermal conductivity. A temperature difference can therefore be formed easily between the opposite ends of the cartridge case 35 on the high temperature end block 4 side and low temperature end block 5 side.

The cartridge type flow rectifier 32 includes a cartridge case 38 and a flow rectifying material 23 which is filled in the cartridge case 38. The cartridge case 38 is mounted in a regenerator side space 21. The cartridge case 38 can be mounted or dismounted via the space in the regenerator case 18.

The cartridge case 35 of the cartridge type regenerator 31 and the cartridge case 38 of the cartridge type flow rectifier 32 may be formed in unison.

The cartridge type flow rectifier 33 includes a cartridge case 39 and a flow rectifying material 24 which is filled in the cartridge case 39. The cartridge case 39 is mounted in a pulse tube side space 22. The cartridge case 39 can be mounted or dismounted via the space in the pulse tube 7.

The cartridge type flow rectifier 34 includes a cartridge case 40 and a flow rectifying material 26 which is filled in the cartridge case 40. The cartridge case 40 is removably mounted in a space 25 communicating the space in the pulse tube 7 with a working gas reciprocal port 12.

The cartridge cases 38, 39 and 40 are made of copper or other metal material having a high thermal conductivity.

An O-ring 41 is disposed between the pulse tube 7 and high temperature end block 4. Another O-ring 42 is disposed between the cartridge case 40 and the inner wall of the space 25. The O-rings 41 and 42 prevent the working gas from entering a gap between the cartridge case 40 and the inner wall of the space 25.

In the pulse tube refrigerator 30 shown in FIG. 1, the regenerating material 19 can be easily exchanged by dismounting the cartridge case 35. The regenerating materials 23, 24 and 26 can be easily exchanged by dismounting the cartridge cases 38, 39 and 40, respectively.

FIG. 2 is a cross sectional view showing the main part of the pulse tube refrigerator under maintenance. The high temperature side block 4 of the pulse tube refrigerator 30 is covered with a glove box 44 in order to prevent air from flowing into the low temperature side when the high temperature side block 4 is dismounted from a precise physical and chemical apparatus 43.

During cold maintenance of the pulse tube refrigerator 30, the operation of the pulse tube refrigerator 30 is stopped without an operation stop and temperature rise of the precise physical and chemical apparatus 43. Mount bolts 17 are loosed and removed and the high temperature end block 4 is dismounted from the flange 16, these works being performed in the glove box 44. By using a jig (not shown) and gloves 45, the cartridge case 35 of the cartridge type regenerator 31 together with the regenerating material 19 is pulled out of the regenerator case 18. A new cartridge case with regenerating material prepared beforehand in the glove boy 44 is inserted into the regenerator case 18.

Similarly, the cartridge type flow rectifiers 32, 33 and 40 can be replaced with new cartridge type rectifiers prepared beforehand.

Figure 3:
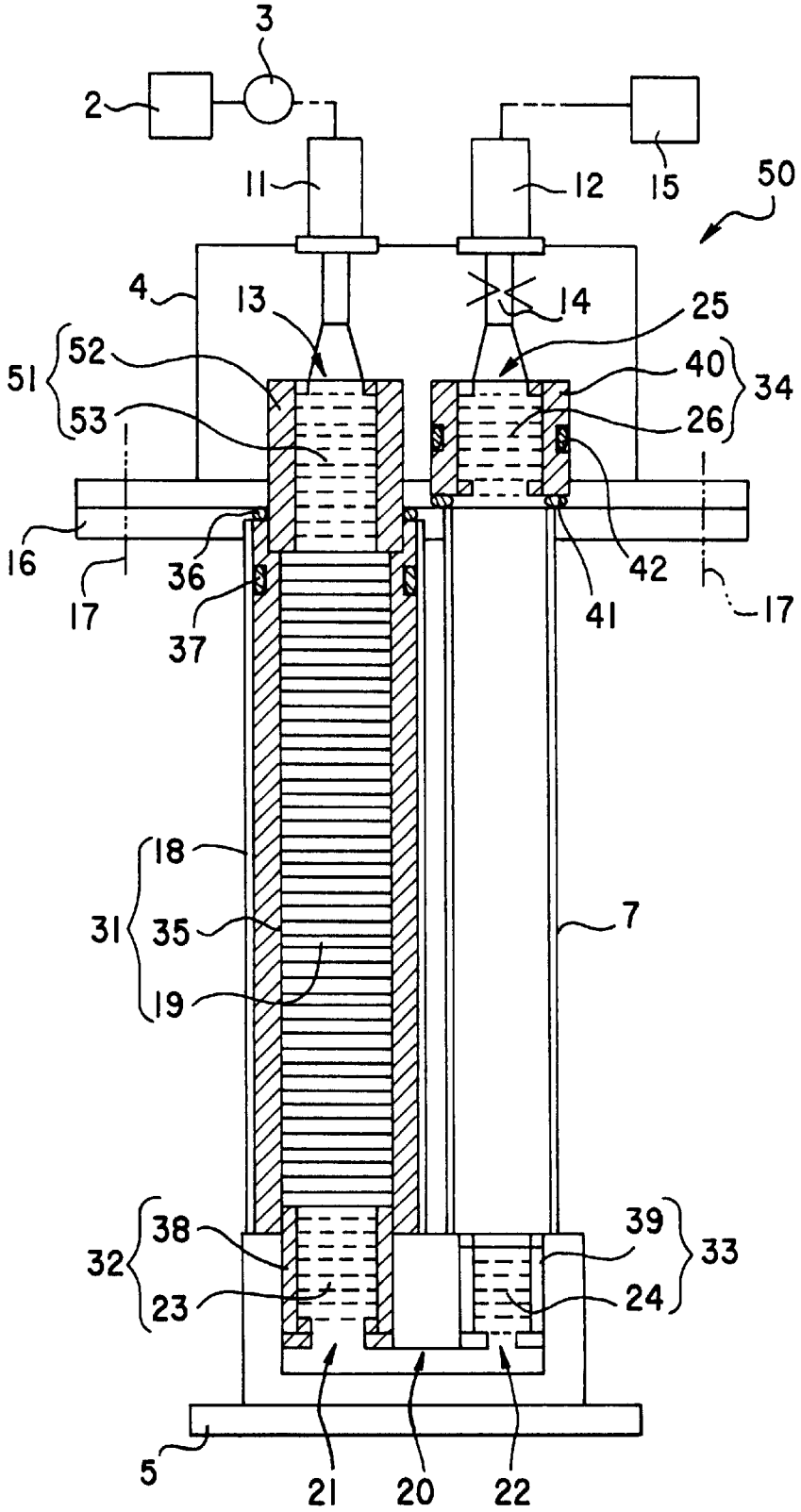
FIG. 3 is a cross sectional view showing the main part of a pulse tube refrigerator according to a second embodiment of the invention.

FIG. 3 is a cross sectional view showing the main part of a pulse tube refrigerator 50 according to a second embodiment of the invention. The pulse tube refrigerator 50 of the second embodiment has an additional cartridge type flow rectifier 51 in addition to the structure of the pulse tube refrigerator 30 of the first embodiment shown in FIG. 1.

The cartridge type flow rectifier 51 is removably disposed in a space 13 communicating the working gas supply port 11 with the high temperature end of the cartridge type regenerator 31. Similar to the cartridge type flow rectifier 32 and the like, the cartridge type flow rectifier 51 includes a cartridge case 52 and a flow rectifying material 53.

The cartridge case 52 is made of copper or other metal material having a high thermal conductivity.

The flow rectifying material 53 is made of metal meshes or punching metal, and filled in the cartridge case 52 at a predetermined density.

In the pulse tube refrigerator 50 of the second embodiment, the cartridge type flow rectifier 51 can be exchanged without raising the temperature at the low temperature side, similar to the cartridge type flow rectifiers 32, 33 and 34 of the pulse tube refrigerator 30 of the first embodiment.

If the cartridge type flow rectifier 51 and cartridge type regenerator 31 are formed in unison, these can be pulled out more easily. If the cartridge type flow rectifier. 51, cartridge type regenerator 31 and cartridge type flow rectifier 32 are formed in unison, these can be pulled out more easily.

In the first and second embodiments, the regenerator and pulse tube are disposed generally parallel between the high temperature end block 4 and low temperature end block 5. A high temperature end block, a regenerator, a low temperature end block, a pulse tube and another high temperature end block may be disposed linearly in this order.

Figure 4:
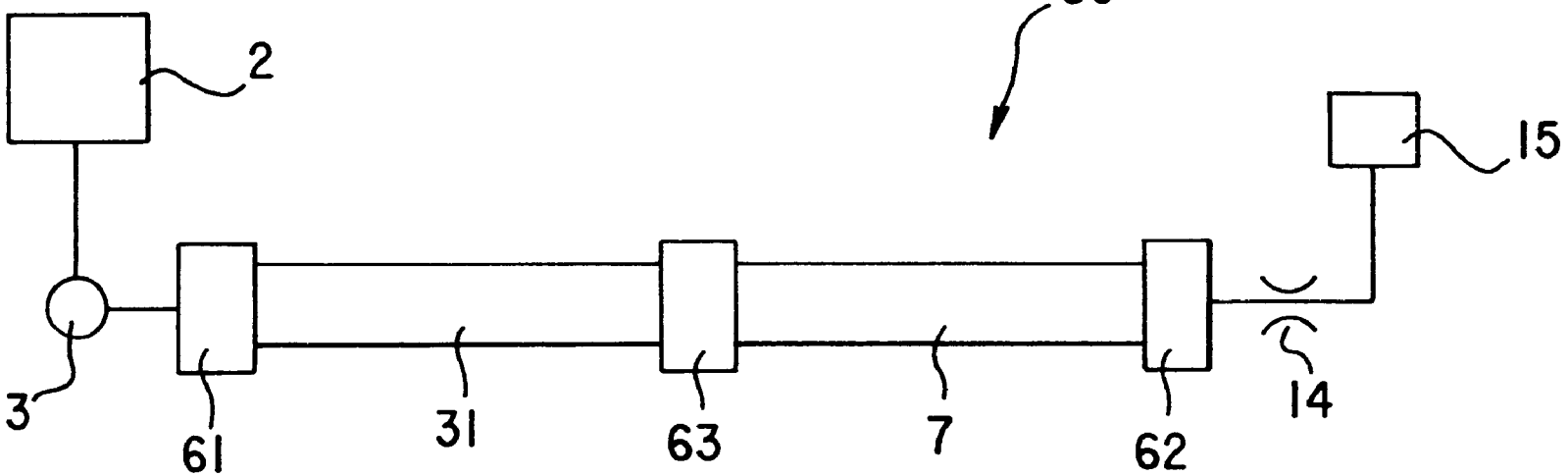
FIG. 4 is a schematic diagram showing a serial type pulse tube refrigerator according to a modification of the first or second embodiment of the invention.

FIG. 4 is a schematic diagram showing a pulse tube refrigerator 60 whose constituent elements from one high temperature end block up to another high temperature end block are disposed linearly. The pulse tube refrigerator 60 has a first high temperature end block 61, a cartridge type regenerator 31, a low temperature end block 63, a pulse tube 7, and a second high temperature end block 62, respectively disposed linearly in this order. A compressor 2 is coupled to the high temperature end block 61 via a pressure changeover valve unit 3. A buffer tank 15 is coupled to the high temperature end block 62 via an orifice 14.

Flow rectifiers similar to the cartridge type flow rectifiers 32, 33, 34 and 51 shown in FIG. 3 are disposed at corresponding positions of the pulse tube refrigerator shown in FIG. 4. Also with the pulse tube refrigerator shown in FIG. 4, since the regenerator and flow rectifiers are of the cartridge type, exchange of these can be performed easily.

Next, with reference to FIG. 5, a pulse tube refrigerator according to a third embodiment will be described.

Figure 5:
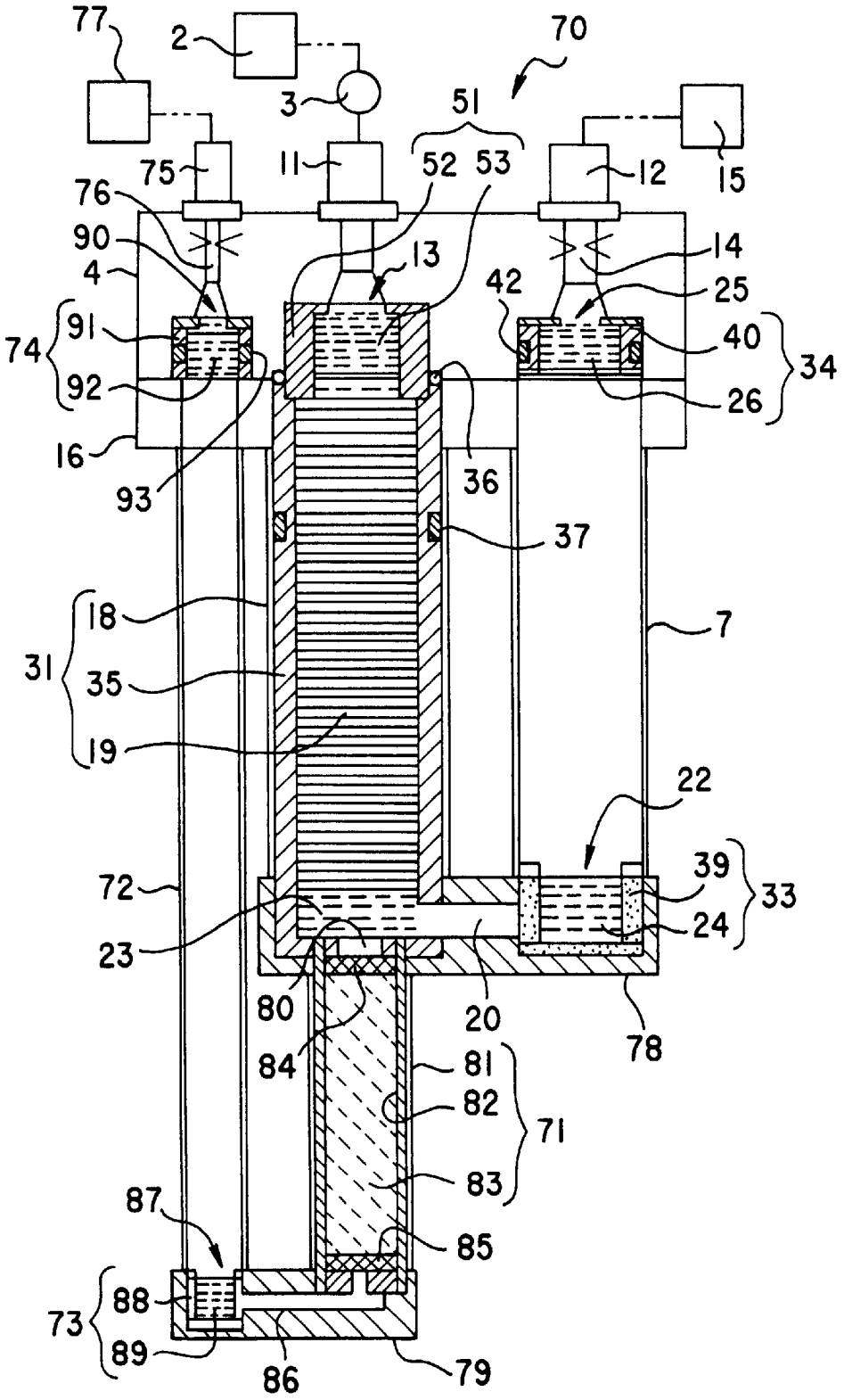
FIG. 5 is a cross sectional view showing the main part of a two-stage type pulse tube refrigerator according to a third embodiment of the invention.

FIG. 5 is a cross sectional view showing the main part of a two-stage type pulse tube refrigerator 70 of the third embodiment. Similar to the pulse tube refrigerator 50 shown in FIG. 3, the pulse tube refrigerator 70 has: a working gas supply port 11 and a working gas reciprocal port 12 formed in a high temperature side block 4; an orifice 14; a buffer tank 15; a pulse tube 7; a cartridge type regenerator 31; and cartridge type flow rectifiers 33, 34 and 51.

The pulse tube refrigerator 70 has also: a second-stage cartridge type regenerator 71; a second-stage pulse tube 72; cartridge type flow rectifiers 73 and 74; a second-stage working gas reciprocal port 75; a second-stage orifice 76; and a second-stage buffer tank 77.

An intermediate block 78 is mounted at the low temperature end of the cartridge type regenerator 31. A commuter space 20 is formed in the intermediate block 78. The commuter space 20 communicates the low temperature end of the cartridge type regenerator 31 with the low temperature end of the pulse tube 7. A low temperature end block 79 is mounted at the low temperature end of the second-stage cartridge type regenerator 71. A commuter space 86 is formed in the low temperature end block 79. The commuter space 86 communicates the low temperature end of the second-stage cartridge type regenerator 71 with the low temperature end of the second-stage pulse tube 72. The high temperature end of the second-stage pulse tube 72 is coupled to the second-stage buffer tank 77 via the second-stage orifice 76 and second-stage working gas reciprocal port 75.

The high temperature end of the second-stage cartridge type regenerator 71 communicates with a space in the commuter space 20 on the regenerator 31 side via a commuter passage 80.

The flow rectifying material 23 is filled in the space of the commuter space 20 on the regenerator 31 side. The flow rectifying material 23 is filled in the cartridge case 35 of the cartridge type regenerator 31, and pulled out together with the regenerator 31.

The second-stage cartridge type regenerator 71 is constituted of a regenerator case 81, a cartridge case 82 and a regenerating material 83. The regenerator case 81 is coupled to the low temperature side of the regenerator case 18. The cartridge case 82 and regenerating material 83 can be pulled out via the space in the regenerator case 18. A flow rectifying material 84 is filled in the regenerator 71 on the high temperature side of the regenerating material 83, and a flow rectifying material 85 is filled in the regenerator 71 on the low temperature side of the regenerating material 83. The flow rectifying materials 84 and 85 are pulled out together with the cartridge case 82 and regenerator 83.

The second-stage pulse tube 72 has a length equal to the total length of the cartridge type regenerator 31 and second-state cartridge type regenerator 71. The low temperature end of the second-stage pulse tube 72 is mounted on the low temperature end block 79, and the high temperature end thereof is mounted on the high temperature end block 4. The cartridge type regenerator 73 is mounted in a space 87 of the commuter space 86 on the second-stage pulse tube 72 side. The cartridge type flow rectifier 74 is mounted in a space 90 between the high temperature end of the second-state pulse tube 72 and the second-stage orifice 76.

The cartridge type flow rectifier 73 has a cartridge case 88 and a flow rectifying material 89 filled in the case 88.

The cartridge type flow rectifier 74 has a cartridge case 91 and a flow rectifying material 92 filled in the case 91.

An O-ring 93 is disposed between the cartridge case 91 and. the inner wall of the space 90. The O-ring 93 prevents the working gas from entering a gap between the inner-wall. of the space 90 and the cartridge case 91.

As the second-stage type pulse tube refrigerator 70 operates, the working gas branches at the low temperature end of the cartridge type regenerator 31 and supplied into the pulse tube 7 and into the second-stage cartridge type regenerator 71. The working gas supplied into the second-stage cartridge type regenerator 71 is supplied into the second-stage pulse tube 72 via the commuter space 86. By repeating a supply and recovery of the working gas, heat is absorbed in the intermediate block 78 and low temperature end block 79.

In the pulse tube refrigerator of the third embodiment, if the regenerating material or flow rectifying material of the cartridge type regenerator 31, 71 or cartridge type flow rectifier 51, 33, 34, 73, 74 is clogged, the material can be easily replaced with a new one.

Figure 6:
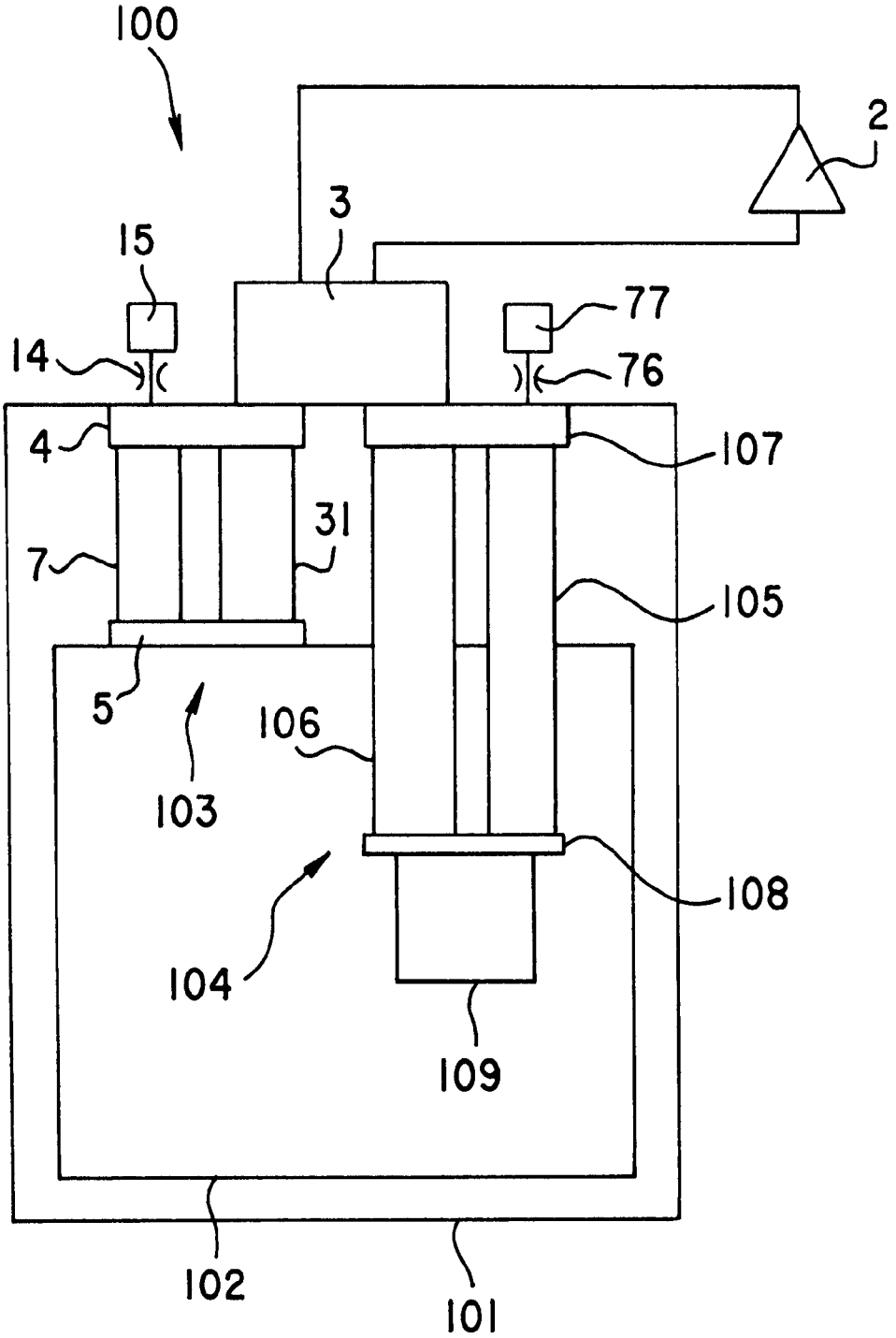
FIG. 6 is a schematic diagram showing a two-stage type pulse tube refrigerator according to a modification of the third embodiment of the invention.

FIG. 6 is a schematic diagram showing a two-stage pulse tube refrigerator 100 according to a modification of the third embodiment. The pulse tube refrigerator 100 has: a compressor 2; a pressure changeover valve unit 3; a vacuum adiabatic chamber 101; a heat shield 102; a first-stage pulse tube refrigerator 103; and a second-stage pulse tube refrigerator 104.

The structures of the first- and second-stage pulse tube refrigerators 103 and 104 are similar to that, of the pulse tube refrigerator 30 shown in FIG. 1 or of the pulse tube refrigerator 50 shown in FIG. 3. Namely, the first-stage pulse tube refrigerator 103 is constituted of a cartridge type regenerator 31, a pulse tube 7, a buffer tank 15, a high temperature end block 4, and a low temperature end block 5. The high temperature end block 4 is mounted on the vacuum adiabatic chamber 101, and the low temperature end block 5 is in thermal contact with the heat shield 102.

The second-stage pulse tube refrigerator 104 is constituted of a cartridge type regenerator 106, a pulse tube 105, a buffer tank 77, a high temperature end block 107, and a low temperature end block 108. The high temperature end block 107 is mounted on the vacuum adiabatic chamber 101. The low temperature end block 108 is thermally shielded from the external by the heat shield 102. A cooling object 109 such as a precise physical and chemical apparatus is in thermal contact with the low temperature end block 108. The central areas of the cartridge type regenerator 106 and pulse tube 105 are also in thermal contact with the heat shield 102.

As shown in FIGS. 1 and 3, in the high temperature end blocks 4 and 107, the cartridge type flow rectifiers 51 and 34 such as shown in FIG. 1 are disposed. The cartridge type flow rectifiers 32 and 33 are also disposed in the low temperature end blocks 5 and 108, respectively.

Also with the two-stage type-pulse tube refrigerator 100 shown in FIG. 6, an exchange work for the cartridge type regenerator 31, 106 or flow rectifier can be performed easily.

The present invention has been described in connection with the preferred embodiments. The invention is not limited only to the above embodiments. It is apparent that various modifications, improvements, combinations, and the like can be made by those skilled in the art.

What is claimed is:

1. A pulse tube refrigerator comprising:

a first pulse tube, a high temperature end and a low temperature end being defined at both ends thereof, and having an inner space;

a first regenerator case of a tubular type, a high temperature end and a low temperature end being defined at both sides thereof;

a first regenerator including a first cartridge case and a first regenerating material filled in the first cartridge case, the first cartridge case being removably inserted into said first regenerator case;

a first passage communicating a space in said first regenerator case on a low temperature end side into which case said first regenerator is inserted, with a space in said first pulse tube on a low temperature end side;

a gas supply unit for repeating a supply and a recovery of a working gas; and a second passage for coupling said gas supply unit to a space in said first regenerator case on a high temperature end side into which case said first regenerator is inserted.

2. A pulse tube refrigerator according to claim 1, further comprising a first flow rectifier filled in an area of said first passage adjacent to the space in said first regenerator case, said first flow rectifier being capable of being removed via the space in said first regenerator case.

3. A pulse tube refrigerator according to claim 1, further comprising a second flow rectifier filled in an area of said first passage adjacent to the space in said first pulse tube, said second flow rectifier being capable of being removed via the space in said first pulse tube.

4. A pulse tube refrigerator according to claim 1, further comprising:

a first buffer tank;

a third passage having a flow resistance for connecting the high temperature end of said first pulse tube to said first buffer tank; and a third flow rectifier removably mounted in said third passage in an area adjacent to the space in said first pulse tube.

5. A pulse tube refrigerator according to claim 1, further comprising a fourth flow rectifier removably mounted in an partial area in said second passage adjacent to the space in said first regenerator case.

6. A pulse tube refrigerator according to claim 1, further comprising:

a second regenerator case of a tubular type, a high temperature end and a low temperature end being defined at both ends thereof, said second regenerator case defining a space in said second regenerator case on a high temperature side, the space communicating with a space in said first regenerator case on a low temperature end side;

a second regenerator including a second cartridge case and a second regenerating material filled in the second cartridge case, the second cartridge case being inserted into said second regenerator case and being capable of being removed via the space in said first regenerator case;

a second pulse tube, a high temperature end and a low temperature end being defined at both ends thereof, and having an inner space; and a fourth passage communicating a space in said second regenerator case on a low temperature end side with a space in said second pulse tube on a low temperature end side.

7. A pulse tube refrigerator according to claim 6, further comprising a fifth flow rectifier filled in an area of said fourth flow path adjacent to the space in said second regenerator case, said fifth flow rectifier being capable of being removed via the space in said second regenerator case.

8. A pulse tube refrigerator according to claim 6, further comprising a sixth flow rectifier filled in an area of said fourth flow path adjacent to the space in said second pulse tube, said fifth flow rectifier being capable of being removed via the space in said second pulse tube.

9. A pulse tube refrigerator according to claim 6, further comprising:

a second buffer tank;

a fifth passage having a flow resistance for connecting the high temperature end of said second pulse tube to said second buffer tank; and a seventh flow rectifier removably mounted in an area in said fifth flow path adjacent to the space in said second pulse tube.

10. A maintenance method for a pulse tube refrigerator having: a pulse tube, a high temperature end and a low temperature end being defined at both ends thereof, and having an inner space; a regenerator case of a tubular type, a high temperature end and a low temperature end being defined at both ends thereof; a regenerator including a cartridge case and a regenerating material filled in the cartridge case, the cartridge case being removably inserted into the regenerator case; a first passage communicating a space in the regenerator case on a low temperature end side into which case the regenerator is inserted, with a space in the pulse tube on a low temperature end side; a gas supply unit for repeating a supply and a recovery of a working gas; and a second path for coupling the gas supply unit to a space in the regenerator case on a high temperature end side into which case the regenerator is inserted, the method comprising the steps of:

stopping an operation of the pulse tube refrigerator;

covering the high temperature end of the regenerator case with a glove box so as to prevent atmospheric air from entering the space in the regenerator case even if the high temperature side of the regenerator case is opened, and preparing a new regenerator in the glove box;

pulling the regenerator out of the regenerator case; and inserting the new regenerator into the regenerator case.

* * * * *